US011988452B2

(12) United States Patent
Jung et al.

(10) Patent No.: US 11,988,452 B2
(45) Date of Patent: May 21, 2024

(54) HEAT EXCHANGER

(71) Applicant: Samsung Electronics Co., Ltd., Suwon-si (KR)

(72) Inventors: Junkyu Jung, Suwon-si (KR); Donghyun Kim, Suwon-si (KR); Kangtae Seo, Suwon-si (KR); Yonghwa Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 289 days.

(21) Appl. No.: 17/309,297

(22) PCT Filed: Dec. 6, 2019

(86) PCT No.: PCT/KR2019/017248
§ 371 (c)(1),
(2) Date: May 17, 2021

(87) PCT Pub. No.: WO2020/138756
PCT Pub. Date: Jul. 2, 2020

(65) Prior Publication Data

US 2022/0011048 A1 Jan. 13, 2022

(30) Foreign Application Priority Data

Dec. 24, 2018 (KR) ..... 10-2018-0168301

(51) Int. Cl.
*F28D 1/053* (2006.01)
*F28F 1/32* (2006.01)
(Continued)

(52) U.S. Cl.
CPC ..... *F28D 1/05383* (2013.01); *F28F 1/325* (2013.01); *F28F 9/0219* (2013.01);
(Continued)

(58) Field of Classification Search
CPC .... F28F 1/325; F28F 2215/08; F28F 2275/06; F28F 9/26; F28F 9/0219; F28F 21/084;
(Continued)

(56) References Cited

U.S. PATENT DOCUMENTS 3,305,009 A * 2/1967 Jentet ..... B21D 53/085 165/182
5,117,902 A * 6/1992 Kusuhara ..... F28F 1/325 165/151
(Continued)

FOREIGN PATENT DOCUMENTS

CN 103782123 B * 8/2016 ..... F25B 39/00
JP H02-166392 A 6/1990
(Continued)

OTHER PUBLICATIONS

International Search Report and Written Opinion of the International Searching Authority in connection with International Application No. PCT/KR2019/017248 dated Mar. 24, 2020, 14 pages.
(Continued)

*Primary Examiner* — Raheena R Malik

(57) ABSTRACT

A heat exchanger is provided. The heat exchanger comprises: a first header comprising a first globe and a second globe; a second header disposed in parallel with the first header; a tube assembly comprising multiple first tubes for connecting the first header and the second header and causing a refrigerant introduced from the first globe to flow in a first direction toward the position of the second header, and multiple second tubes disposed continuously with the multiple first tubes so as to cause a refrigerant introduced from the second header to flow in a second direction that is opposite to the first direction; and multiple heat exchange-fins individually having multiple insertion portions, into which the multiple first tubes and the multiple second tubes are inserted, respectively, and heat exchange surfaces dis-
(Continued)

posed between the multiple insertion portions. The first heat-exchange fin, which is adjacent to the first header among the multiple heat exchange fins, has a heat-exchange surface including a first surface having a louver formed thereon, and a second surface formed to be flat and adjacent to insertion portions into which multiple second tubes are inserted. The second heat-exchange fin, which is adjacent to the second header, has a heat-exchange surface including a first surface.

10 Claims, 15 Drawing Sheets

(51) Int. Cl.
*F28F 9/02* (2006.01)
*F28F 21/08* (2006.01)

(52) U.S. Cl.
CPC ..... *F28F 21/084* (2013.01); *F28F 2215/08* (2013.01); *F28F 2260/02* (2013.01)

(58) Field of Classification Search
CPC ..... F28F 2260/02; F28D 1/05383; F28D 7/0008; F28D 2021/0021
See application file for complete search history.

(56) References Cited

U.S. PATENT DOCUMENTS 5,896,920 A * 4/1999 Jun ..... F28D 1/0477 165/181
5,934,363 A * 8/1999 Jung ..... F28F 1/325 165/146
6,644,389 B1 * 11/2003 Kang ..... F28F 1/325 165/181
7,111,670 B2 * 9/2006 Yoshioka ..... F28D 1/0478 165/151
7,677,057 B2 * 3/2010 Yanik ..... B23K 1/0012 62/506
9,328,973 B2 * 5/2016 Jindou ..... F25B 39/00
9,441,890 B2 * 9/2016 Kim ..... F28F 1/28
9,829,257 B2 * 11/2017 Oohigashi ..... F28D 1/0477
10,309,701 B2 * 6/2019 Morimoto ..... F28F 1/022
10,627,165 B2 * 4/2020 Seo ..... F28F 1/128
10,712,104 B2 * 7/2020 Maeda ..... F28D 1/05391
11,262,107 B2 * 3/2022 Yoshioka ..... F25B 39/00
11,346,609 B2 * 5/2022 Satou ..... F25B 39/00
2006/0070726 A1 * 4/2006 Yoshioka ..... F28F 1/325 165/151
2011/0120177 A1 * 5/2011 Kirkwood ..... F28F 1/325 165/173
2013/0292098 A1 * 11/2013 Jindou ..... F28F 1/022 165/151
2014/0116667 A1 * 5/2014 Choi ..... F28F 1/10 165/172
2014/0190425 A1 * 7/2014 Oohigashi ..... F24H 9/0031 122/18.4
2015/0083377 A1 * 3/2015 Jindou ..... F25B 39/022 165/143
2016/0116234 A1 4/2016 Murase et al.
2017/0292741 A1 * 10/2017 Inoue ..... F28F 9/0212
2017/0307305 A1 * 10/2017 Tanda ..... F28F 1/325
2017/0334028 A1 * 11/2017 Karasawa ..... B65G 61/00
2018/0073809 A1 3/2018 Seo et al.
2018/0093321 A1 * 4/2018 Karasawa ..... B23P 15/26
2018/0106563 A1 * 4/2018 Nakamura ..... F28D 1/05366
2018/0120039 A1 * 5/2018 Nakamura ..... F28F 17/005
2018/0135900 A1 * 5/2018 Jindou ..... F28D 1/0435
2018/0243813 A1 * 8/2018 Karasawa ..... B21D 53/085
2018/0356166 A1 * 12/2018 Wang ..... F28F 1/30
2019/0120557 A1 * 4/2019 Nagano ..... F28F 1/32
2019/0128623 A1 * 5/2019 Maeyama ..... F28D 1/05383
2019/0170372 A1 * 6/2019 Yoshioka ..... F24F 1/0067
2020/0318911 A1 * 10/2020 Shabtay ..... B23K 1/008
2020/0363107 A1 * 11/2020 Satou ..... F28F 9/22
2021/0041115 A1 * 2/2021 Yoshioka ..... F28F 1/32
2021/0123638 A1 * 4/2021 Yoshioka ..... F28F 1/325
2021/0180878 A1 * 6/2021 Maeda ..... F28D 1/05366
2021/0254897 A1 * 8/2021 Matsumoto ..... F28F 1/022
2021/0262740 A1 * 8/2021 Matsumoto ..... F28F 17/005
2022/0011048 A1 * 1/2022 Jung ..... F28F 1/325
2022/0155029 A1 * 5/2022 Shimano ..... F28D 1/05366
2022/0212278 A1 * 7/2022 Yamada ..... B23K 1/0012
2022/0243988 A1 * 8/2022 Yamada ..... F25B 41/24
2022/0246493 A1 * 8/2022 Peng ..... H01L 23/3672
2022/0268525 A1 * 8/2022 Satou ..... F25B 13/00
2022/0274216 A1 * 9/2022 Pelletier ..... B21D 53/085

FOREIGN PATENT DOCUMENTS

JP H06-147785 A 5/1994
JP 3942210 B2 7/2007
JP 2013-204913 A 10/2013
JP 2016-205744 A 12/2016
KR 10-2008-0022324 A 3/2008
KR 10-2010-0099774 A 9/2010
KR 10-2013-0084179 A 7/2013
KR 10-2014-0055945 A 5/2014
KR 10-1568200 B1 11/2015
KR 10-2016-118653 A 10/2016
KR 10-2018-0029730 A 3/2018
KR 10-1890826 B1 8/2018

OTHER PUBLICATIONS

Request for the Submission of an Opinion dated May 30, 2023, in connection with Korean Patent Application No. 10-2018-0168301, 11 pages.
Decision of Rejection dated Nov. 27, 2023, in connection with Korean Patent Application No. 10-2018-0168301, 6 pages.

* cited by examiner

HEAT EXCHANGER

CROSS-REFERENCE TO RELATED APPLICATIONS

This application is a 371 National Stage of International Application No. PCT/KR2019/017248 filed Dec. 6, 2019, which claims priority to Korean Patent Application No. 10-2018-0168301 filed Dec. 24, 2018, the disclosures of which are herein incorporated by reference in their entirety.

BACKGROUND

1. Field

The disclosure relates to a heat exchanger with improved heat exchange efficiency.

2. Description of Related Art

An air conditioner is a device that includes an indoor unit, an outdoor unit, and a refrigerant circulating therebetween. The air conditioner cools or heats a predetermined space by releasing heat to the surrounding when the refrigerant is liquefied and absorbing heat from the surrounding when the refrigerant is vaporized.

A heat exchanger for exchanging heat with the outside is disposed in the outdoor unit of the air conditioner. A refrigerant is circulated in the heat exchanger to exchange heat with the outside. For example, when the air conditioner operates for cooling, high-temperature and high-pressure refrigerant may be condensed in the heat exchanger to release heat to the outside. In addition, when the air conditioner operates for heating, low-temperature and low-pressure refrigerant may be evaporated in the heat exchanger to absorb heat from the outside. In other words, the heat exchanger may be used as a condenser or an evaporator depending on the characteristics of the refrigerant flowing in the heat exchanger.

Further, the heat exchanger includes heat exchange fins for maximizing an area for exchanging heat with the outside. However, when the heat exchanger operates as a condenser, there is a problem in that heat exchange efficiency is deteriorated because external air and water vapor contact the surface of the heat exchange fins of the heat exchanger through which a low-temperature and low-pressure refrigerant flows, resulting in frosting.

SUMMARY

An object of the present disclosure is to provide a heat exchanger with improved heat exchange efficiency.

In order to achieve the above object, the disclosure may provide a heat exchanger including a first header including a first mouth and a second mouth; a second header disposed parallel to the first header; a tube assembly configured to connect the first header and the second header, the tube assembly including a plurality of first tubes configured to flow a refrigerant introduced from the first mouth in a first direction in which the second header is located and a plurality of second tubes that are continuously disposed with the plurality of first tubes and configured to flow the refrigerant introduced from the second header in a second direction opposite to the first direction; and a plurality of heat exchange fins including a plurality of insertion portions into which the plurality of first tubes and the plurality of second tubes are inserted and heat exchange surfaces provided between the plurality of insertion portions, wherein heat exchange surfaces of each of first heat exchange fins adjacent to the first header among the plurality of heat exchange fins include a first surface on which a louver is formed and a second surface flatly formed adjacent to insertion portions into which the plurality of second tubes are inserted, and heat exchange surfaces of each of second heat exchange fins adjacent to the second header include the first surface.

The tube assembly may be disposed at an equal interval.

The plurality of first tubes are disposed at a first interval, the plurality of second tubes are disposed at a second interval, and the first interval may be smaller than the second interval.

The first surface of the heat exchange surfaces of the first heat exchange fins may have a first length equal to the first interval, and the second surface may have a second length equal to the second interval.

Each of the plurality of heat exchange fins may include a protrusion formed extending from one end of each of the heat exchange surfaces.

The protrusion may protrude more than the plurality of first tubes and the plurality of second tubes respectively inserted into the plurality of insertion portions.

The first header may include first insertion holes into which one end of the tube assembly is inserted; and a partition wall disposed between the first mouth and the second mouth. The second header may include second insertion holes into which another end of the tube assembly is inserted.

Each of the plurality of first tubes and the plurality of second tubes may be formed of aluminum (Al) material and may include a plurality of microchannels.

The heat exchanger may include a third header including a third mouth and fourth mouth and disposed in parallel with the first header at a rear of the first header; a fourth header disposed in parallel with the second header at a rear of the second header; a rear tube assembly configured to connect the third header and the fourth header, and disposed in parallel with the tube assembly at a rear of the tube assembly; and a plurality of heat exchange fins disposed along a length direction of the tube assembly and including third heat exchange fins disposed adjacent to the third header and fourth heat exchange fins disposed adjacent to the fourth header, wherein the rear tube assembly may include a plurality of third tubes configured to flow a refrigerant introduced from the third mouth in a third direction in which the third header is located; and a plurality of fourth tubes configured to flow the refrigerant introduced from the third mouth in a fourth direction opposite to the third direction and disposed in zigzag with the plurality of second tubes.

Heat exchange surfaces of each of the third heat exchange fins may include a third surface on which a louver is formed and a fourth surface flatly formed adjacent to insertion portions into which the plurality of fourth tubes are inserted, and heat exchange surfaces of each of the fourth heat exchange fins may include the third surface.

According to the heat exchanger according to an embodiment of the disclosure having the above structure, because heat exchange area with external air passing through the heat exchanger may be increased with a plurality of heat exchange fins, heat exchange efficiency of the heat exchanger may be improved.

DETAILED DESCRIPTION

Embodiments of the disclosure will be described with reference to the accompanying drawings, for comprehensive understanding of the constitution and the effect of the disclosure. The disclosure is not limited to the embodiments described herein, but may be implemented in various forms, and various modifications may be made to the embodiments of the disclosure. The descriptions of the embodiments of the disclosure are provided to make the descriptions of the disclosure complete, and to apprise people having ordinary knowledge in the technical field to which the disclosure belongs to fully understand the range of the disclosure. Meanwhile, in the accompanying drawings, components were illustrated in more enlarged sizes greater than their actual sizes for the convenience of description, and the proportion of each component may be exaggerated or reduced.

Herein, a component described as "on top of" or "contacts" another component should be understood to impart that a component may directly contact or be connected with the top portion of another component, but still another component may exist between the components. In contrast, a component described as "just on top of" or "directly contacts" another component should be understood to impart that still another component does not exist between the components. Other expressions describing relations between components, for instance, expressions such as "between~" and "directly between~" may be interpreted in the same manner.

Meanwhile, terms such as "the first," "the second," and the like may be used to describe various components, but the components are not limited by the terms. Such terms are used only to distinguish one component from another component. For example, a first component may be called a second component, and a second component may be called a first component in a similar manner, without departing from the scope of the disclosure.

Also, singular expressions include plural expressions, unless defined obviously differently in the context. Further, in this specification, terms such as "include" or "have" should be construed as designating that there are such characteristics, numbers, steps, operations, elements, components or a combination thereof described in the specification, and they may be interpreted to denote that one or more of other characteristics, numbers, steps, operations, elements, components or a combination thereof may be added.

The terms used in the embodiments of the disclosure may be interpreted as meanings generally known to those of ordinary skill in the art described in the disclosure, unless defined differently in the disclosure.

Hereinafter, a structure of a heat exchanger 1 according to an embodiment of the disclosure will be described with reference to FIGS. 1 to 5.

Figure 1:
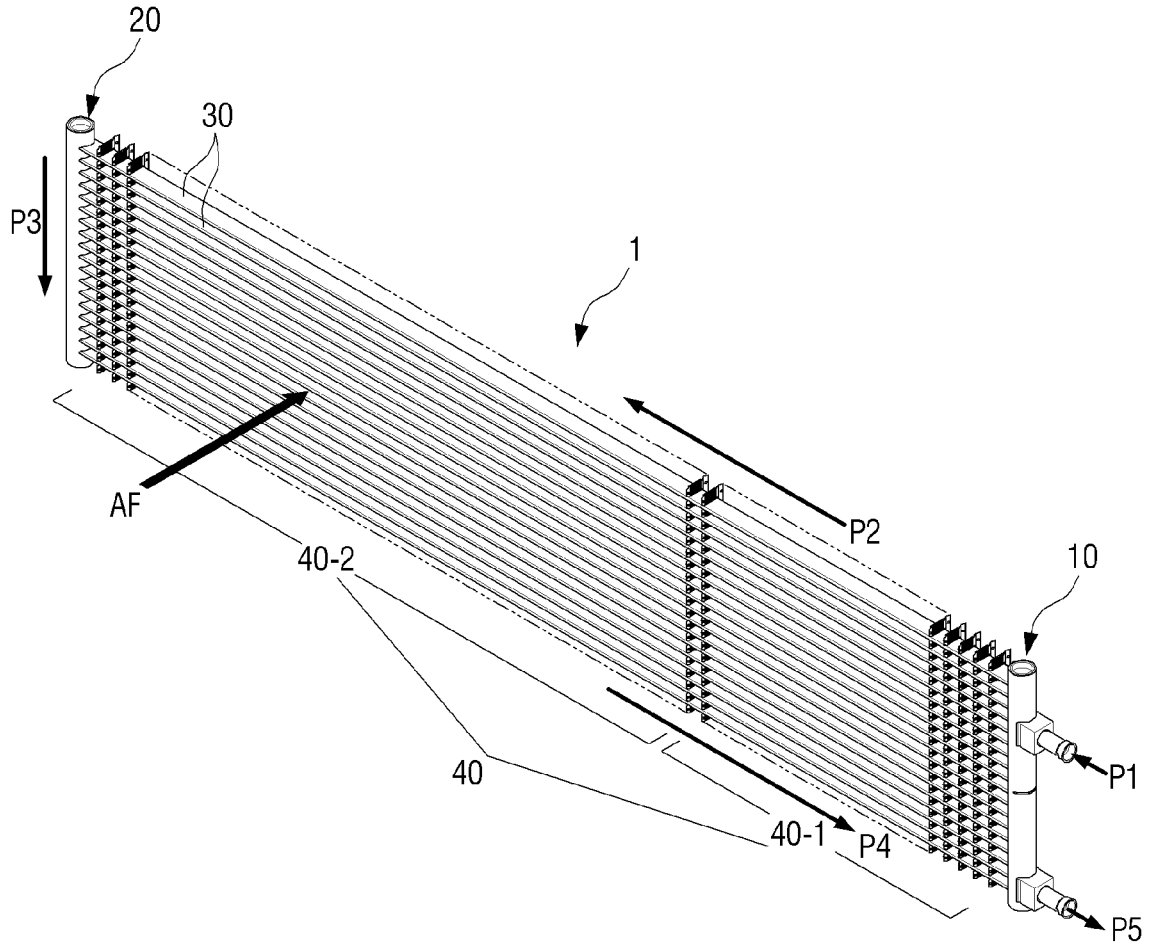
FIG. 1 is a perspective view illustrating a heat exchanger according to an embodiment of the disclosure.
Figure 2:
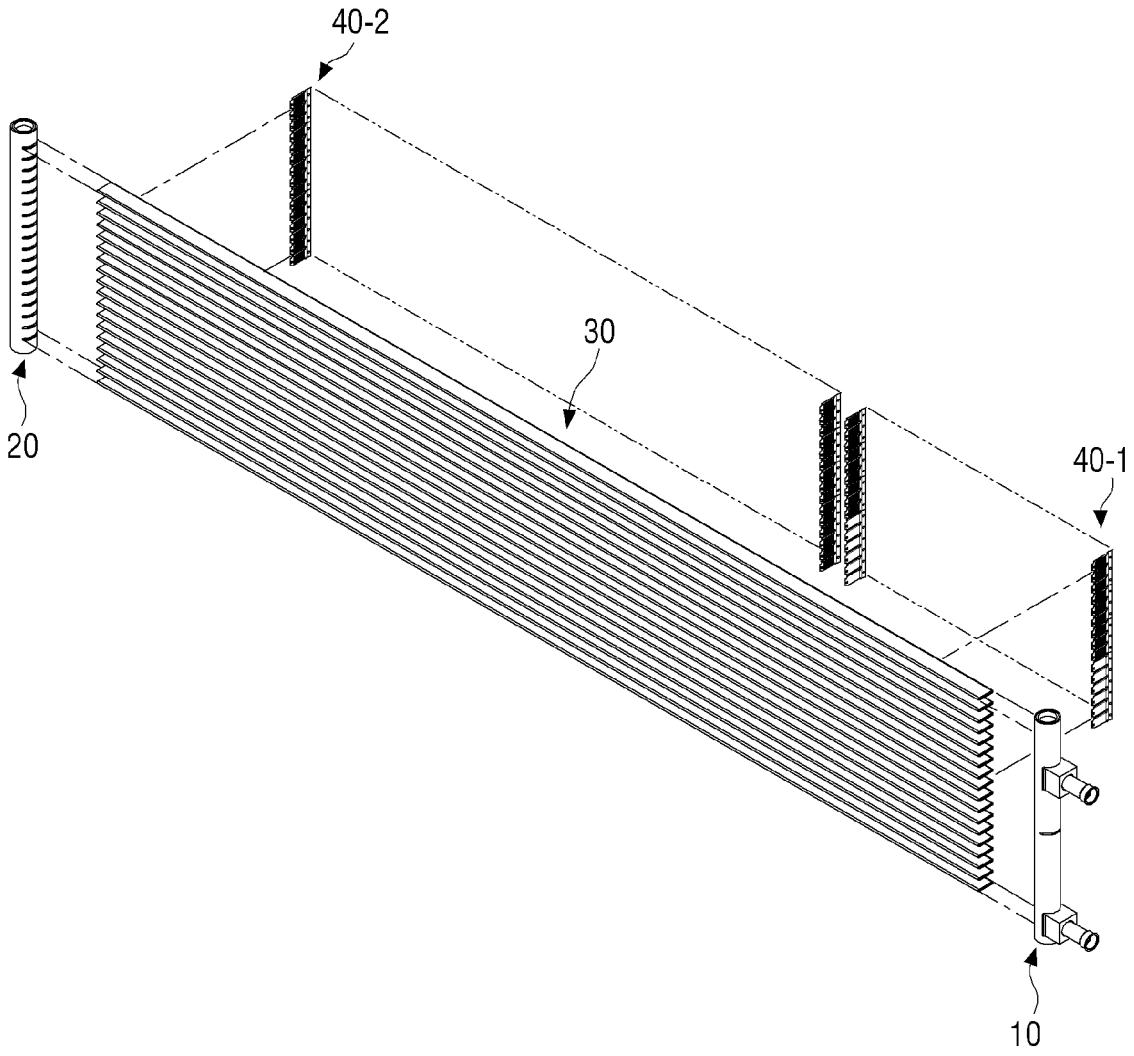
FIG. 2 is an exploded perspective view illustrating a heat exchanger according to an embodiment of the disclosure.
Figure 3:
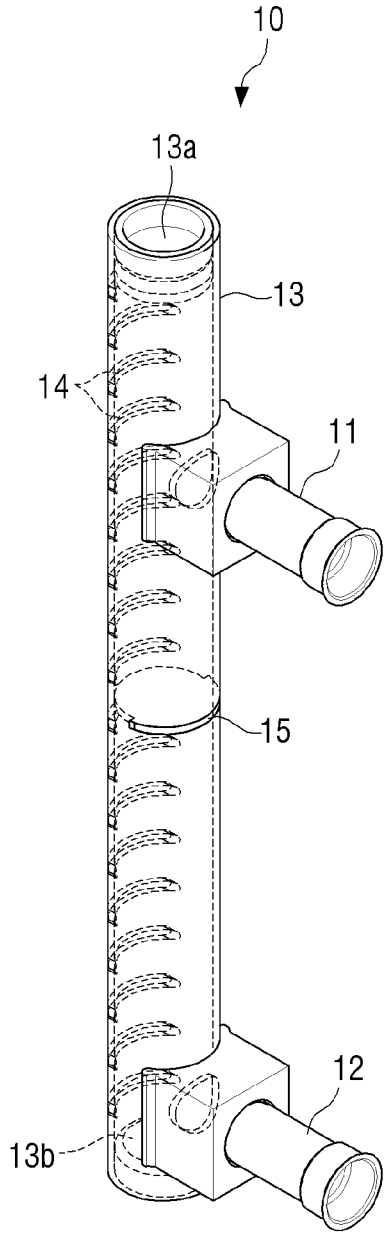
FIG. 3 is a perspective view illustrating a first header according to an embodiment of the disclosure.
Figure 4:
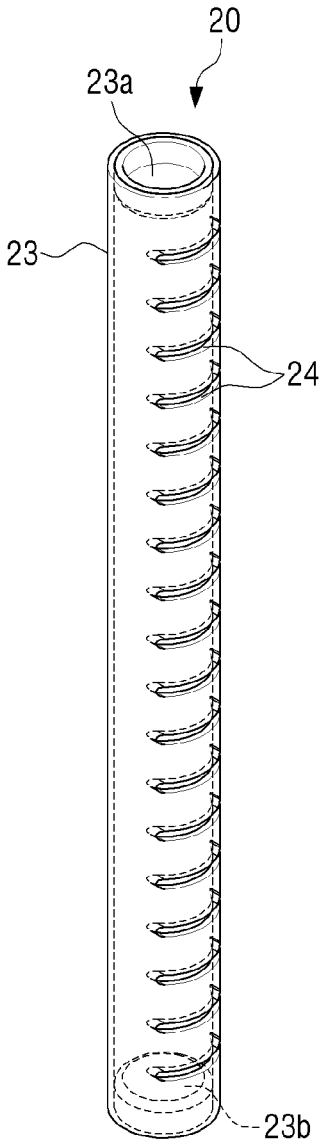
FIG. 4 is a perspective view illustrating a second header according to an embodiment of the disclosure.
Figure 5:
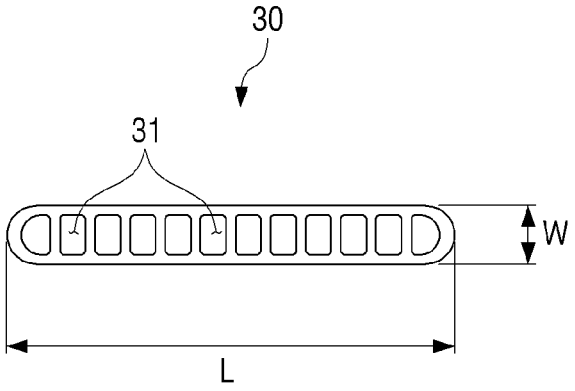
FIG. 5 is a cross-sectional view illustrating one tube of a tube assembly.

FIGS. 1 is a perspective view illustrating a heat exchanger 1 according to an embodiment of the disclosure. FIG. 2 is an exploded perspective view illustrating a heat exchanger 1 according to an embodiment of the disclosure. FIG. 3 is a perspective view illustrating a first header 10 according to an embodiment of the disclosure. FIG. 4 is a perspective view illustrating a second header 20 according to an embodiment of the disclosure. FIG. 5 is a cross-sectional view illustrating one tube of a tube assembly 30.

The heat exchanger 1 may include a first header 10 including a first mouth 11 and a second mouth 12, a second header 20 arranged in parallel with the first header 10, a tube assembly 30 that is disposed between the first header 10 and the second header 20 and connects the first header 10 and the second header 20, and a plurality of heat exchange fins 40 disposed at predetermined intervals along the length direction of the tube assembly 30.

As illustrated in FIG. 3, the first header 10 may include the first mouth 11 through which refrigerant flows in, the second mouth 12 through which the refrigerant flows out, a first header body 13 having a cylindrical shape, first insertion holes 14 into which one end of the tube assembly 30 is inserted, and a partition wall 15 disposed between the first mouth 11 and the second mouth 12.

The first mouth 11 may be formed on one side of the first header body 13 and may be communicated with the inner space of the first header body 13. The first mouth 11 may be formed to allow the refrigerant to flow in and out, and may have various shapes.

The second mouth 12 may be formed on the other side of the first header body 13 and may be communicated with the inner space of the first header body 13. The second mouth 12 may be disposed parallel to the first mouth 11. In addition, the second mouth 12 may be formed to allow the refrigerant to flow in and out, and may have various shapes.

The first mouth 11 and the second mouth 12 may be an inlet and an outlet of the refrigerant of the heat exchanger 1. For example, the refrigerant flowing in through the first mouth 11 may flow out through the second mouth 12 after passing through the circulation structure of the heat exchanger 1.

However, the disclosure is not limited thereto, and the first mouth 11 may be an outlet of the refrigerant and the second mouth 12 may be an inlet of the refrigerant.

The first header body 13 may have a cylindrical shape and may distribute the refrigerant introduced from the first mouth 11 to the tube assembly 30. For example, the refrigerant introduced from the first mouth 11 may flow into a plurality of tubes 30-1 through the first insertion holes 14 formed in the first header body 13.

In addition, sidewalls 13*a* and 13*b* of the first header body 13 may prevent the refrigerant inside the first header body 13 from leaking to the outside.

The first insertion holes 14 are openings into which the tube assembly 30 is inserted, and may correspond to the shape of each tube of the tube assembly 30. In addition, the number of the first insertion holes 14 may correspond to the number of a plurality of tubes included in the tube assembly 30.

Accordingly, one end of each of the plurality of tubes included in the tube assembly 30 may be inserted into each of the first insertion holes 14, so that the tube assembly 30 may be connected to the first header 10.

The partition wall 15 may be disposed inside the first header body 13 to partition the inside of the first header body 13. Accordingly, the refrigerant introduced through the first mouth 11 may be prevented from directly flowing out through the second mouth 12.

For example, the refrigerant introduced through the first mouth 11 may not flow into the second mouth 12 due to the partition wall 15, but may flow into the plurality of first tubes 30-1 of the tube assembly 30. In addition, the refrigerant flowing from the second header 20 into the first header body 13 through a plurality of second tubes 30-2 of the tube assembly 30 may not flow into the first mouth 11 but may flow out through the second mouth 12 due to the partition wall 15.

In addition, the first header 10 may be made of aluminum (Al) material, and may be integrally formed.

The second header 20 may be disposed parallel to the first header 10 and may change the direction of the refrigerant introduced from the tube assembly 30 to allow the refrigerant to flow in the direction in which the first header 10 is located.

For example, the refrigerant flowing in a first direction P2 through the plurality of first tubes 30-1 may be changed to a conversion direction P3 perpendicular to the first direction P2 through the second header 20, and then may flow in a second direction P4 opposite to the first direction P2 through the plurality of second tubes 30-2.

In other words, the second header 20 may be disposed at the other end of the tube assembly 30 and may be connected to the tube assembly 30.

Referring to FIG. 4, the second header 20 may include a second header body 23 having a cylindrical shape and second insertion holes 24 into which the other end of the tube assembly 30 is inserted.

The second header body 23 may have a cylindrical shape, and may flow the refrigerant, which is introduced from the plurality of first tubes 30-1 in the first direction P2, in the second direction P4 opposite to the first direction P2 through the plurality of second tubes 30-2.

Therefore, unlike the first header 10, the second header 20 may have a structure in which a separate partition wall is not disposed thereinside. Accordingly, the refrigerant introduced from the plurality of first tubes 30-1 into the second header 20 may flow to the plurality of second tubes 30-2.

In addition, sidewalls 23*a* and 23*b* of the second header body 23 may be disposed to prevent the refrigerant inside the second header body 23 from leaking to the outside.

The second insertion holes 24 are openings into which the tube assembly 30 is inserted, and may correspond to the shape of each tube of the tube assembly 30. In addition, the number of the second insertion holes 24 may correspond to the number of the plurality of tubes included in the tube assembly 30.

Accordingly, the other end of each of the plurality of tubes included in the tube assembly 30 may be inserted into each of the second insertion holes 24, so that the tube assembly 30 may be connected to the second header 20.

In addition, the number of second insertion holes 24 is the same as the number of first insertion holes 14.

Further, the second header 20 may be disposed such that the second insertion holes 24 of the second header 20 face the first insertion holes 14 of the first header 10.

The tube assembly 30 may be disposed between the first header 10 and the second header 20 to connect the first header 10 and the second header 20. Accordingly, the refrigerant may circulate the first header 10 and the second header 20 through the tube assembly 30.

In addition, the tube assembly 30 may be a passage through which the refrigerant flows and may exchange heat with the outside. For example, when the refrigerant is in a state of high-temperature and high-pressure, the refrigerant may discharge heat to the outside atmosphere while flowing through the tube assembly 30. In addition, when the refrigerant is in a state of low-temperature and low-pressure, the refrigerant may absorb heat from the outside atmosphere while flowing through the tube assembly 30.

Here, the high-temperature and high-pressure of the refrigerant and the low-temperature and low-pressure of the refrigerant may be determined based on the state of the outside atmosphere.

In addition, the tube assembly 30 may include a plurality of tubes having the same shape. In detail, as illustrated in FIG. 5, each of the tubes included in the tube assembly 30 may include a plurality of microchannels 31.

The plurality of microchannels 31 may be composed of fine-sized channels, and may be arranged in a row. Accordingly, the area in which the refrigerant passing through the plurality of microchannels 31 contacts may be increased, thereby improving heat exchange efficiency with the outer atmosphere.

In addition, each of the tubes included in the tube assembly 30 may have a size capable of being inserted into an insertion portion 41 of the heat exchange fins 40. For example, the length L and the width W of the tube may correspond to the lengths R1 and R2 and the widths W1 and W2 of the insertion portions 41. For example, the width W of the tube may have a size such that the tube is fitted to the insertion portion 41.

In addition, the tube assembly 30 may include the plurality of first tubes 30-1 (see FIG. 8) configured to flow the refrigerant introduced from the first mouth 11 in the first direction P2 in which the second header 20 is located and the plurality of second tubes 30-2 (see FIG. 8) configured to flow the refrigerant introduced from the second header 20 in the second direction P4 opposite to the first direction P2 and continuously disposed with the plurality of first tubes 30-1.

The plurality of first tubes 30-1 and the plurality of second tubes 30-2 may include tubes having the same shape, and may be classified depending on the flow direction of the refrigerant flowing in the plurality of first tubes 30-1 and the plurality of second tubes 30-2.

Figure 8:
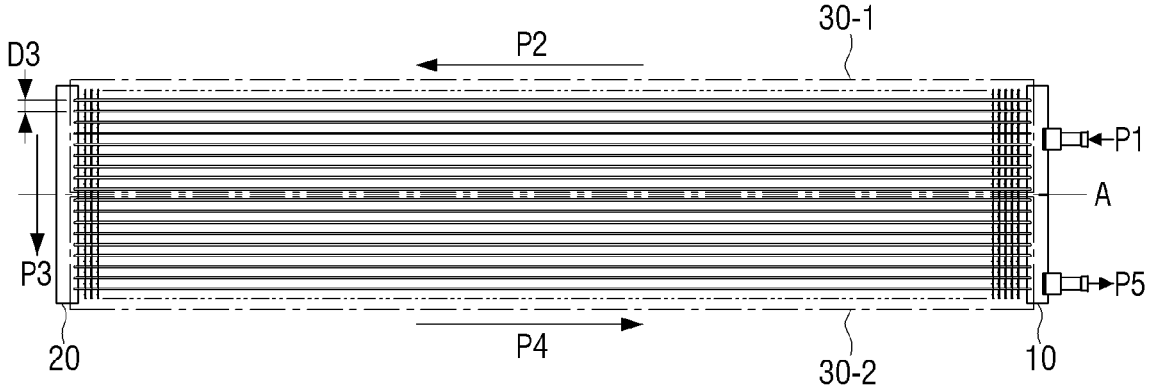
FIG. 8 is a side view illustrating a heat exchanger according to an embodiment of the disclosure.

For example, as illustrated in FIG. 8, based on an extension line A of the partition wall 15 of the first header 10, the tube assembly 30 disposed above the extension line A may be the plurality of first tubes 30-1, and the tube assembly 30 disposed under the extension line A may be the plurality of second tubes 30-2.

Accordingly, the refrigerant flowing into the first mouth 11 of the first header 10 may flow in the first direction P2 through the plurality of first tubes 30-1, the flow direction thereof may be changed in the second header 20, and the refrigerant may flow in the second direction P4 through the plurality of second tubes 30-2, and then may flow out through the second mouth 12 of the first header 10.

In addition, the number of tubes included in the plurality of first tubes 30-1 may be different from the number of tubes included in the plurality of second tubes 30-2. However, if necessary, the number of tubes included in the plurality of first tubes 30-1 may be the same as the number of tubes included in the plurality of second tubes 30-2.

The plurality of first tubes 30-1 and the plurality of second tubes 30-2 may be sequentially disposed in a predetermined direction. In addition, one end of each of the plurality of first tubes 30-1 and the plurality of second tubes 30-2 may be connected to the first header 10, and the other end of each of the plurality of first tubes 30-1 and the plurality of second tubes 30-2 may be connected to the second header 20.

In addition, as illustrated in FIG. 8, the tube assembly 30 may be disposed at the same interval D3. For example, the arrangement interval of the plurality of first tubes 30-1 may be the same as the arrangement interval of the plurality of second tubes 30-2.

The plurality of first tubes 30-1 and the plurality of second tubes 30-2 may have the same shape, and may be made of an aluminum (Al) material. Therefore, compared to the tube assembly made of copper tubes, the manufacturing cost may be reduced.

In addition, the first header 10, the second header 20, and the tube assembly 30 may be integrally formed.

Hereinafter, a detailed structure of the plurality of heat exchange fins 40 will be described with reference to FIGS. 6A to 7B.

Figure 6A:
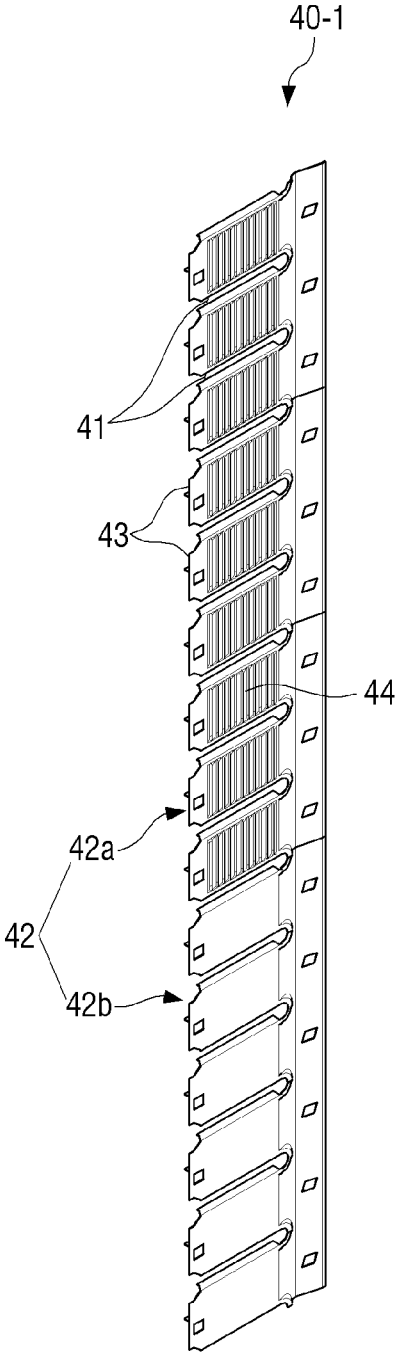
FIG. 6A is a perspective view illustrating a first heat exchange fin according to an embodiment of the disclosure.
Figure 6B:
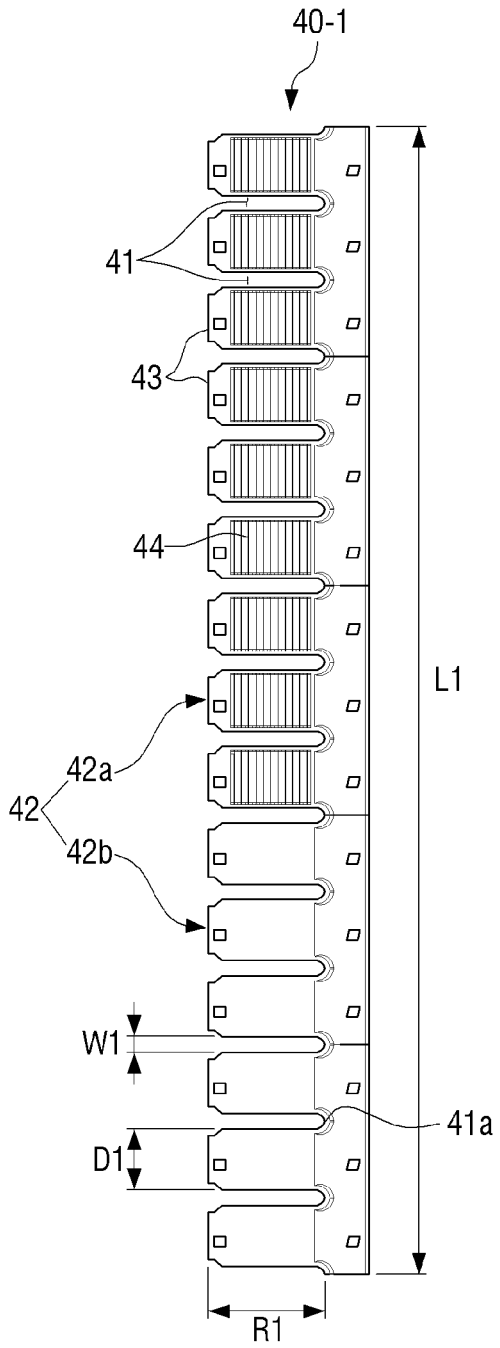
FIG. 6B is a side view illustrating a first heat exchange fin according to an embodiment of the disclosure.
Figure 7A:
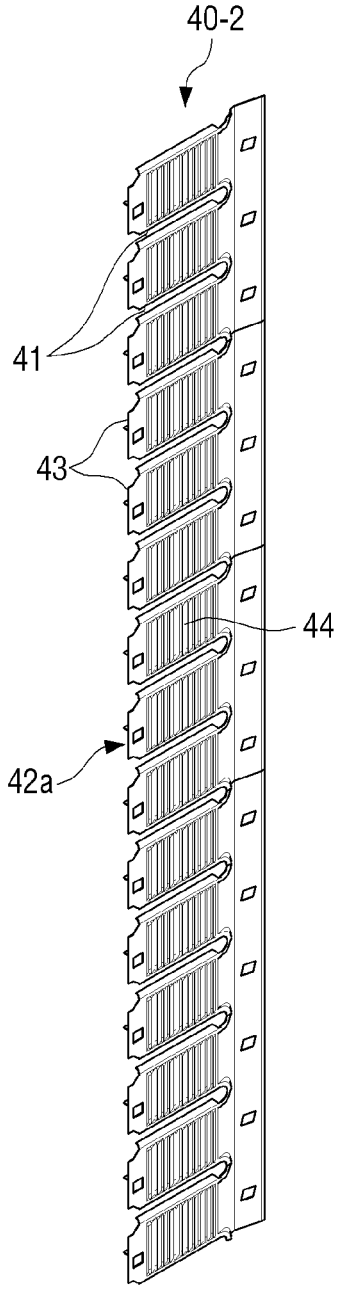
FIG. 7A is a perspective view illustrating a second heat exchange fin according to an embodiment of the disclosure.
Figure 7B:
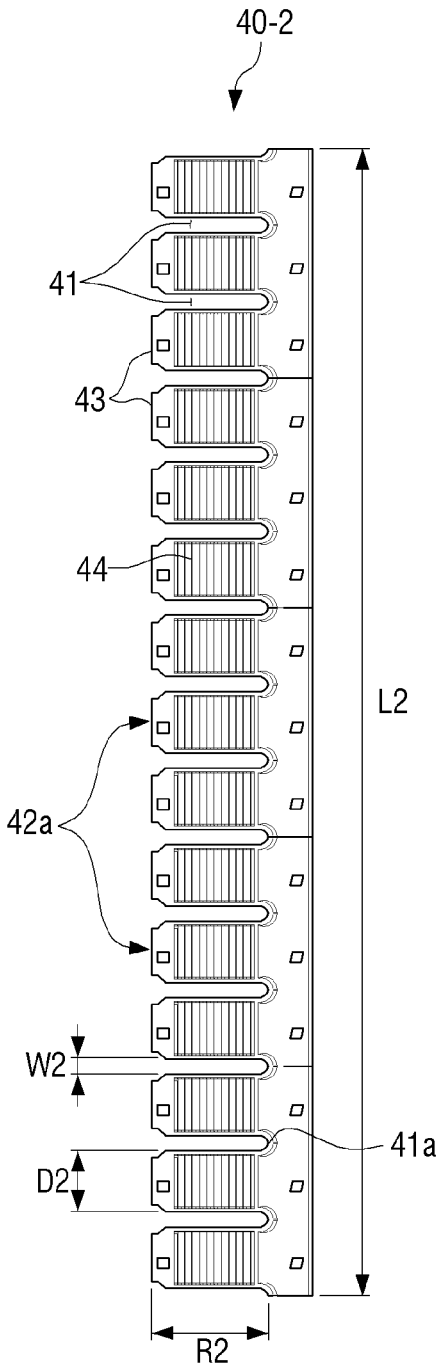
FIG. 7B is a side view illustrating a second heat exchange fin according to an embodiment of the disclosure.

FIG. 6A is a perspective view illustrating a first heat exchange fin 40-1 according to an embodiment of the disclosure, and FIG. 6B is a side view illustrating a first heat exchange fin 40-1 according to an embodiment of the disclosure. FIG. 7A is a perspective view illustrating a second heat exchange fin 40-2 according to an embodiment of the disclosure, and FIG. 7B is a side view illustrating a second heat exchange fin 40-2 according to an embodiment of the disclosure.

The plurality of heat exchange fins 40 may be disposed at predetermined intervals along the length direction of the tube assembly 30 to increase a heat exchange area with external air AF passing through the heat exchanger 1. Accordingly, the plurality of heat exchange fins 40 may improve heat exchange efficiency of the heat exchanger 1.

In addition, the plurality of heat exchange fins 40 may be coupled to the tube assembly 30 in a direction parallel to the first header 10 and the second header 20. For example, the plurality of heat exchange fins 40 may be provided parallel to the direction of the external air AF flowing into the heat exchanger 1, so that resistance to the external air AF may be minimized.

Each of the plurality of heat exchange fins 40 may include a plurality of insertion portions 41 into which the plurality of first tubes 30-1 and the plurality of second tubes 30-2 are inserted and a plurality of heat exchange surfaces 42 provided between the plurality of insertion portions 41.

The plurality of insertion portions 41 are portions into which the tube assembly 30 is inserted, and may be disposed with a first width D1 corresponding to the interval D3 between the tubes of the tube assembly 30. Here, the first width D1 may mean the length of one heat exchange surface 42. In addition, the width W1 of each of the plurality of insertion portions 41 may be formed in consideration of the width W of the tube to be inserted into the insertion portion 41.

In addition, the shape of each of the plurality of insertion portions 41 may correspond to the shape of the tube to be inserted into each of the plurality of insertion portions 41.

Further, the number of the plurality of insertion portions 41 may correspond to the number of tubes to be inserted into the plurality of insertion portions 41. For example, the number of the plurality of insertion portions 41 may be equal to or greater than the sum of the number of the plurality of first tubes 30-1 and the number of the plurality of second tubes 30-2.

Accordingly, the plurality of insertion portions 41 fix the plurality of first tubes 30-1 and the plurality of second tubes 30-2 to one heat exchange fin 40, so that the heat exchange fin 40 may exchange heat with external air flowing around the plurality of first tubes 30-1 and the plurality of second tubes 30-2.

The heat exchange surfaces 42 are provided between the plurality of insertion portions 41 and may contact the tube assembly 30 to increase the contact area with the external air AF flowing through the heat exchanger 1.

In other words, the plurality of insertion portions 41 and the plurality of heat exchange surfaces 42 may be alternatively disposed. Accordingly, the heat exchange surfaces 42 may be disposed between the plurality of first tubes 30-1 and the plurality of second tubes 30-2 inserted into one heat exchange fin 40, respectively.

In addition, the heat exchange fins 40 may be formed of a thin plate. For example, the heat exchange fins 40 may be formed of a thin aluminum plate.

Further, the heat exchange surfaces 42 may include a first surface 42*a* in which a louver 44 is formed on the heat exchange surface 42 and a second surface 42*b* formed as a flat surface. In other words, the second surface 42*b* may mean a surface on which the louver 44 is not formed.

Here, the louver 44 may mean that long thin flat plates are arranged horizontally, vertically, or in a grid shape, and may have the same shape as slots. Accordingly, the louver 44 may increase the contact area with external air AF passing through the heat exchanger 1 to improve the heat exchange efficiency of the heat exchanger 1.

In addition, the plurality of heat exchange fins 40 may include a protrusion 43 formed to extend from one end of the heat exchange surface 42. In addition, the protrusion 43 may be formed to protrude more than the plurality of first tubes 30-1 and the plurality of second tubes 30-2 inserted into the plurality of insertion portions 41.

Accordingly, when the frosting occurs in the heat exchanger 1 and the frosted portion is melted or when water vapor condenses on the surface of the tube assembly 30, the condensed water droplets may be discharged from the heat exchanger 1 in a predetermined direction through the protrusions 43.

The plurality of heat exchange fins 40 may include first heat exchange fins 40-1 having the first surfaces 42*a* in which the louver 44 is formed and the second surfaces 42*b* flatly formed adjacent to the insertion portions into which the plurality of second tubes 30-2 are inserted and second heat exchange fins 40-2 formed only with the first surfaces 42*a* in which the louver 44 is formed.

In other words, based on whether the second surface 42*b* is included, the heat exchange fin 40 including the second surface 42*b* may be referred to as the first heat exchange fin

40-1, and the heat exchange fin 40 not including the second surface 42*b* may be referred to as the second heat exchange fin 40-2.

Here, because the first heat exchange fin 40-1 and the second heat exchange fin 40-2 have the plurality of insertion portions 41 and the plurality of heat exchange surfaces 42 identically, the overlapping description is omitted.

First, as illustrated in FIGS. 6A and 6B, the heat exchange surfaces 42 of the first heat exchange fin 40-1 may include the first surfaces 42*a* in which the louver 44 is formed and the second surfaces 42*b* formed flat.

Here, the first surfaces 42*a* and the second surfaces 42*b* have the same size, and may be classified according to whether or not the louver 44 is formed. For example, when the first heat exchange fin 40-1 is produced by a press process, the first surfaces 42*a* are stamped by a mold configured to form the shape of the louver 44, whereas the second surfaces 42*b* are not stamped by the mold configured to form the shape of the louver 44.

In addition, the first surfaces 42*a* and the second surfaces 42*b* may be sequentially disposed. For example, the first surfaces 42*a* are arranged along the length L1 of the first heat exchange fin 40-1, and then the second surfaces 42*b* may be arranged. In other words, the first surfaces 42*a* may be formed at one end of the first heat exchange fin 40-1, and the second surfaces 42*b* may be formed at the other end of the first heat exchange fin 40-1.

In addition, the second surfaces 42*b* of the first heat exchange fin 40-1 may be provided adjacent to the insertion portions into which the plurality of second tubes 30-2 are inserted. Accordingly, when the first heat exchange fin 40-1 is disposed adjacent to the first header 10, the second surfaces 42*b* may be located adjacent to the second mouth 12, which is an outlet of the refrigerant.

Therefore, when the heat exchanger 1 operates as an evaporator, considering that the temperature of the refrigerant flowing out through the second mouth 12 is lower than the temperature of the refrigerant flowing into the first mouth 11, by positioning the second surfaces 42*b* adjacent to the second mouth 12, frosting may be prevented from occurring on the second surfaces 42*b*.

In detail, the temperature of the liquid refrigerant introduced from the first mouth 11 absorbs heat from the external air, but due to the phase change to the gaseous state and the pressure loss in the process of flowing, the temperature of the liquid refrigerant is higher than the temperature of the refrigerant flowing out of the second mouth 12.

For example, the liquid phase refrigerant introduced from the first mouth 11 absorbs heat from the external air and changes phase, so that the temperature of the liquid phase refrigerant introduced from the first mouth 11 becomes lower. However, the temperature thereof may rise by continuously absorbing heat from the external air. However, the temperature of the refrigerant flowing out of the second mouth 12 is lower than the temperature of the refrigerant flowing into the first mouth 11 due to the pressure loss during the flow process.

Therefore, by disposing the second surfaces 42*b* adjacent to the second mouth 12, the occurrence of frost on the second surfaces 42*b* by contacting the second surfaces 42*b* with water vapor contained in the external air AF passing through the heat exchanger 1 may be prevented.

In addition, when the external air AF passes through the heat exchanger 1, the air resistance of the first surface 42*a* in which the louver 44 is formed is greater than the air resistance of the second surface 42*b* formed as a flat surface. Therefore, by arranging the second surfaces 42*b* in a predetermined area adjacent to the second mouth 12, the air resistance when the external air AF passes through the heat exchanger 1 may be adjusted, so that the power consumption of the heat exchanger 1 may be reduced.

In addition, as illustrated in FIGS. 7A and 7B, the heat exchange surfaces 42 of the second heat exchange fin 40-2 may be formed as the first surface 42*a* in which the louver 44 is formed. In other words, the heat exchange surfaces 42 of the second heat exchange fin 40-2 may be composed of only the first surfaces 42*a*.

Further, the length L2 of the second heat exchange fin 40-2 may be the same as the length L1 of the first heat exchange fin 40-1. In addition, the width W2 and length R2 of the insertion portion 41 of the second heat exchange fin 40-2 may be the same as the width W1 and length R1 of the insertion portion 41 of the first heat exchange fin 40-1. Further, the width D2 of the first surface 42*a* of the second heat exchange fin 40-2 may be the same as the width D1 of the first surface 42*a* and the second surface 42*b* of the first heat exchange fin 40-1.

In other words, except that the first heat exchange fin 40-1 includes the second surfaces 42*b*, the shape of the first heat exchange fin 40-1 may be the same as the shape of the second heat exchange fin 40-2.

Accordingly, in the process of manufacturing the plurality of heat exchange fins 40, by not selectively forming the louver 44 in the first heat exchange fin 40-1, the first heat exchange fin 40-1 and the second heat exchange fin 40-2 may be formed by a similar process. Therefore, because the processes of manufacturing the first heat exchange fins 40-1 and the second heat exchange fins 40-2 are not separately provided, the manufacturing cost of the plurality of heat exchange fins 40 may be reduced.

In addition, as illustrated in FIG. 1, the first heat exchange fins 40-1 may be disposed adjacent to the first header 10, and the second heat exchange fins 40-2 may be disposed adjacent to the second header 20.

Here, the ratio in which the first heat exchange fins 40-1 and the second heat exchange fins 40-2 are disposed may vary as necessary.

Accordingly, the second surfaces 42*b* of the first heat exchange fins 40-1 may be disposed adjacent to the second mouth 12 of the first header 10, which is an outlet of the refrigerant.

Hereinafter, an operation of the heat exchanger 1 according to an embodiment of the disclosure will be described with reference to FIGS. 1 and 8.

FIG. 8 is a side view illustrating a heat exchanger 1 according to an embodiment of the disclosure.

First, the refrigerant flows into the first mouth 11 of the first header 10 (P1). Thereafter, the refrigerant introduced into the first mouth 11 may exchange heat with external air AF passing through the heat exchanger 1 while flowing in the first direction P2 along the plurality of first tubes 30-1 connected to the first header 10.

Next, the flow of the refrigerant may be changed in the conversion direction P3 perpendicular to the first direction P2 through the second header 20 connected to the plurality of first tubes 30-1.

Thereafter, the refrigerant whose direction is changed through the second header 20 may exchange heat with the external air AF passing through the heat exchanger 1 while flowing in the second direction P4 opposite to the first direction P2 through the plurality of second tubes 30-2 connected to the second header 20.

At this time, when the heat exchanger 1 operates as a condenser, a high-temperature and high-pressure refrigerant may condensed in the heat exchanger 1 to discharge heat to the outside through the heat exchanger 1. In addition, when the heat exchanger 1 operates as an evaporator, a low-temperature and low-pressure refrigerant may be evaporated in the heat exchanger 1 to absorb heat from the outside.

Next, the refrigerant may flow out through the second mouth 12 of the first header 10 connected to the plurality of second tubes 30-2.

Accordingly, the heat exchanger 1 may minimize the area occupied by the heat exchanger 1 and increase the heat exchange area of the heat exchanger 1 as much as possible through the refrigerant circulation structure on the same plane.

In addition, by selectively disposing the second surfaces 42*b* of the first heat exchange fin 40-1 adjacent to the second mouth 12, the occurrence of frosting around the second mouth 12 having the a low temperature may be prevented.

Further, by selectively disposing the first heat exchange fins 40-1 and the second heat exchange fins 40-2 along the length direction of the tube assembly 30, through a simple structure, the frosting may be prevented and high heat exchange efficiency may be realized.

Hereinafter, a detailed structure of a heat exchanger 1 according to a modified embodiment of the disclosure will be described with reference to FIGS. 9 to 10B.

Figure 9:
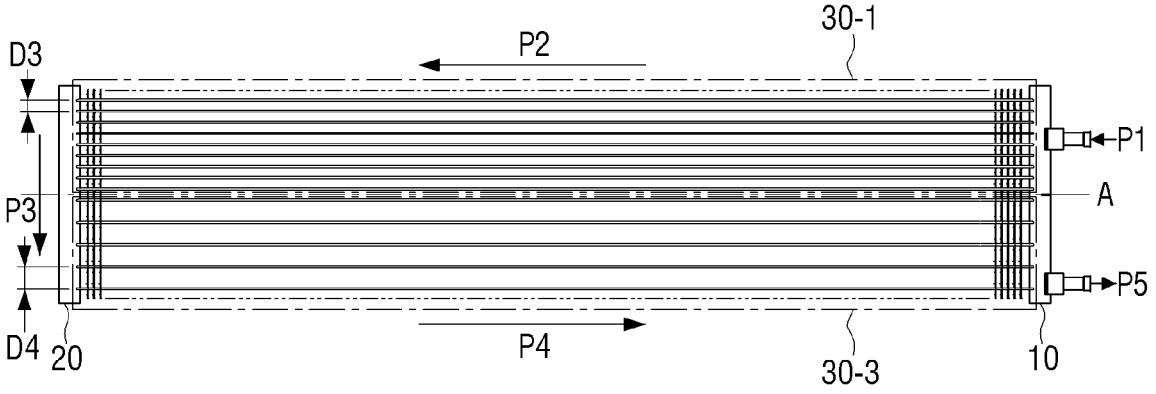
FIG. 9 is a side view illustrating a heat exchanger according to a modified embodiment of the disclosure.
Figure 10A:
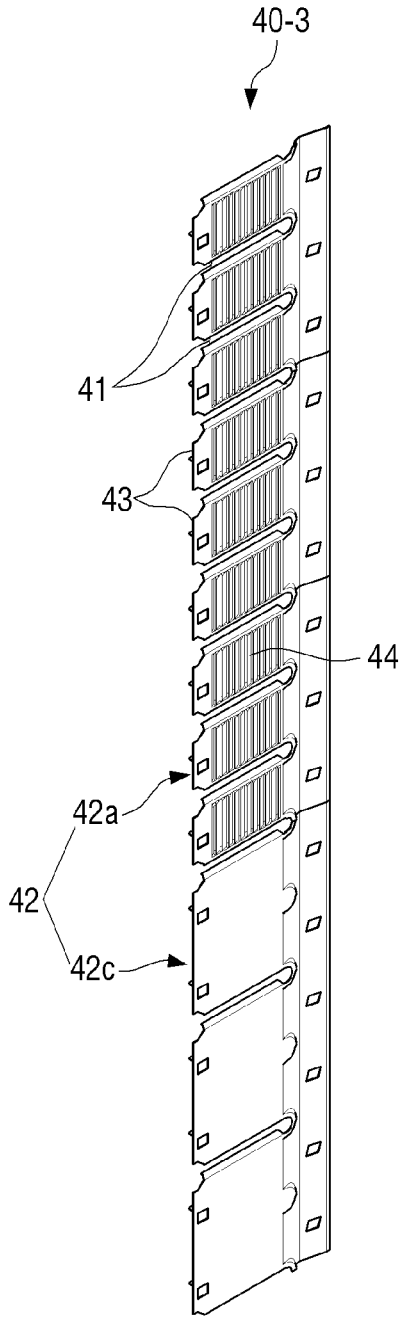
FIG. 10A is a perspective view illustrating a third heat exchange fin according to a modified embodiment of the disclosure.

FIG. 9 is a side view illustrating a heat exchanger 1 according to a modified embodiment of the disclosure. FIG. 10A is a perspective view illustrating a third heat exchange fin 40-3 according to a modified embodiment of the disclosure. FIG. 10B is a side view illustrating a third heat exchange fin 40-3 according to a modified embodiment of the disclosure.

Here, the same reference numerals are used for the same configuration, and redundant descriptions are omitted. For example, overlapping descriptions of the first header 10, the second header 20, the plurality of insertion portions 41, the first surfaces 42*a*, the protrusions 43, and the louver 44 are omitted.

As illustrated in FIG. 9, the intervals between the tubes included in the tube assembly 30 may vary. For example, the tube assembly 30 may include a plurality of first tubes 30-1 disposed at a first interval D3 and a plurality of third tubes 30-3 disposed at a second interval D4 greater than the first interval D3.

Here, the plurality of fifth tubes 30-3 are the same as the plurality of second tubes 30-2 except that the interval between the fifth tubes 30-3 is different from the interval between the second tubes 30-2. In other words, the plurality of fifth tubes 30-3 are arranged at different intervals from the plurality of second tubes 30-2.

Figure 10B:
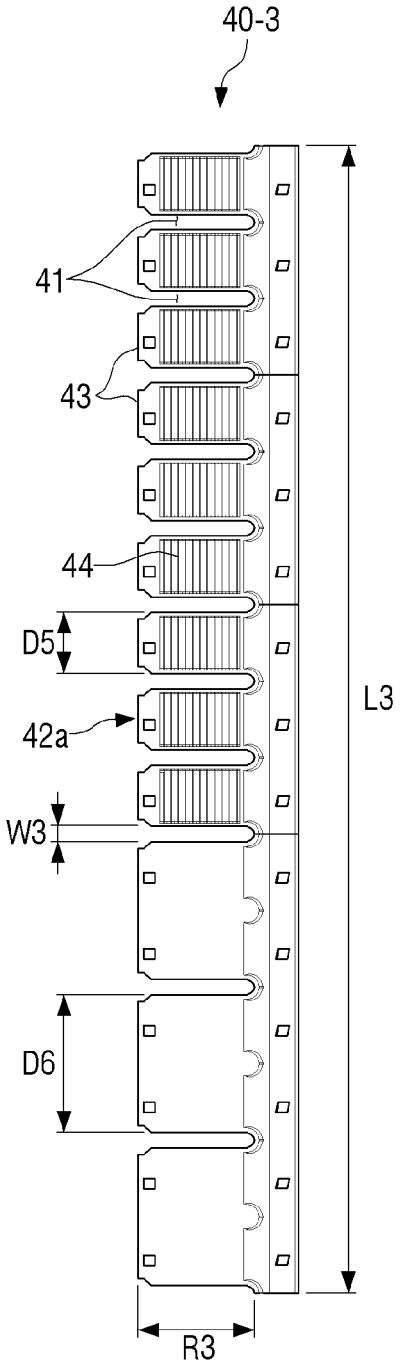
FIG. 10B is a side view illustrating a third heat exchange fin according to a modified embodiment of the disclosure.

In addition, as illustrated in FIGS. 10A and 10B, the second length D6 of a third surface 42*c*, which is disposed adjacent to the insertion portions into which the plurality of fifth tubes 30-3 of the third heat exchange fin 40-3 are inserted and is flatly formed, may be larger than the first length D5 of the first surface 42*a*.

For example, the first surface 42*a* may be formed to have the first length D5 equal to the first interval D3 of the plurality of first tubes 30-1, and the third surface 42*c* may be formed to have the second length D6 equal to the second interval D4.

Here, the third heat exchange fin 40-3 has the same structure as the first heat exchange fin 40-1, except that the length of the second surface 42*b* of the first heat exchange fin 40-1 is changed.

Accordingly, by increasing the interval between the plurality of fifth tubes 30-3 connected to the second mouth 12, which is lower than the temperature of the refrigerant introduced from the first mouth 11, the heat exchange rate of the portion adjacent to the second mouth 12 may be reduced, so that the occurrence of the frosting on the portion adjacent to the second mouth 12 may be prevented.

Hereinafter, a structure of a heat exchanger 1 according to another modified embodiment of the disclosure will be described with reference to FIGS. 11 and 12.

Figure 11:
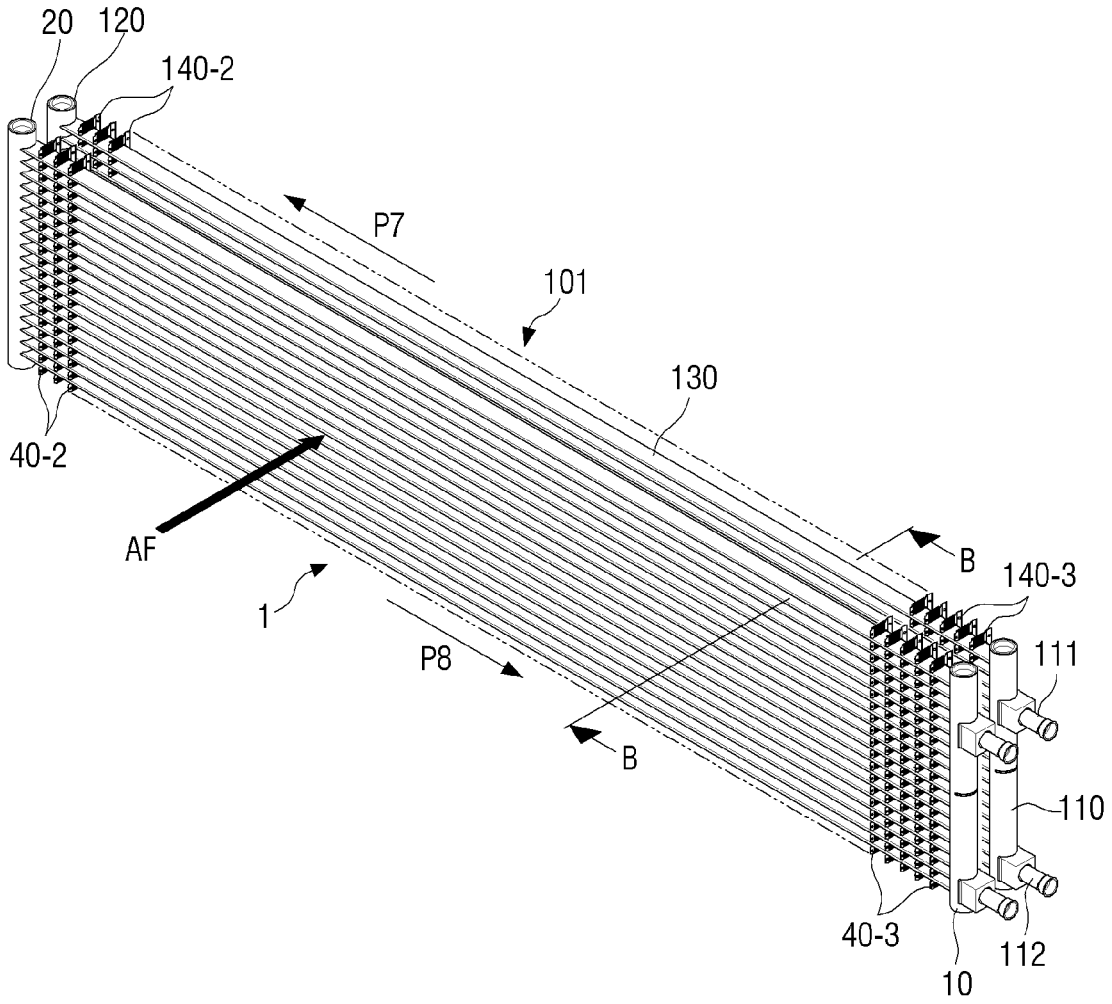
FIG. 11 is a perspective view illustrating a heat exchanger according to another modified embodiment of the disclosure.

FIG. 11 is a perspective view illustrating a heat exchanger 1 according to another modified embodiment of the disclosure. FIG. 12 is a cross-sectional view taken along line B-B of FIG. 11.

As illustrated in FIG. 11, a rear heat exchanger 101 may be disposed behind the heat exchanger 1 including the first header 10, the second header 20, the tube assembly 30, and the plurality of heat exchange fins 40.

In detail, the rear heat exchanger 101 may include a third header 110 that includes a third mouth 111 and a fourth mouth 112 and is disposed in parallel with the first header 10 at the rear of the first header 10, a fourth header 120 disposed in parallel with the second header 20 at the rear of the second header 20, a rear tube assembly 130 that connects the third header 110 and the fourth header 120 and is disposed in parallel with the tube assembly 30 at the rear of the tube assembly 30, and a plurality of heat exchange fins 140 that are disposed along the length direction of the tube assembly 30 and include third heat exchange fins 140-3 disposed adjacent to the third header 110 and fourth heat exchange fins 140-2 disposed adjacent to the fourth header 120.

Here, the third header 110 and the first header 10 have the same structure, and the fourth header 120 and the second header 20 have the same structure; therefore, redundant descriptions are omitted.

The rear tube assembly 130 may include a plurality of third tubes 130-1 configured to flow the refrigerant introduced from the third mouth 111 in a third direction P7 in which the third header 110 is located and a plurality of fourth tubes 130-3 that are configured to flow the refrigerant introduced from the third header 110 in a fourth direction P8 opposite to the third direction P7 and are disposed in a zigzag with the plurality of second tubes 30-3.

Here, the plurality of second tubes 30-3 have the same structure as the plurality of fifth tubes 30-3.

Figure 12:
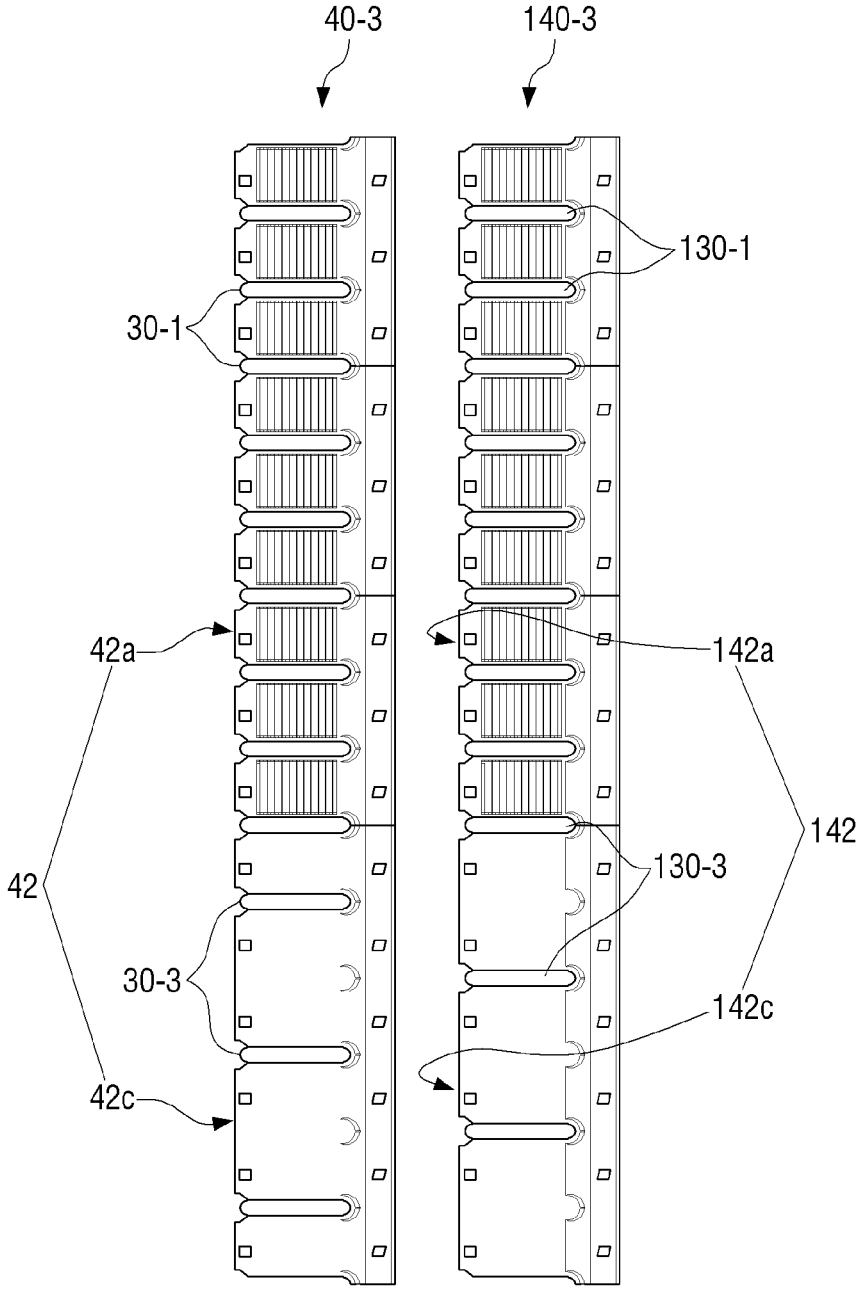
FIG. 12 is a cross-sectional view taken along line B-B of FIG. 11.

In other words, as illustrated in FIG. 12, each of the plurality of first tubes 30-1 and each of the plurality of fifth tubes 30-3 may be disposed side by side. The plurality of second tubes 30-3 and the plurality of fourth tubes 30-4 may be alternately disposed with respect to the direction of the external air AF flowing into the heat exchanger 1.

In addition, heat exchange surfaces of the third heat exchange fin 140-3 may include a third surface 142*a* in which the louver 44 is formed and a fourth surface 142*c* flatly formed adjacent to insertion portions into which the plurality of fourth tubes 130-3 are inserted. Heat exchange surfaces of the fourth heat exchange fin 140-2 may include the third surfaces 142*a*.

In other words, the fourth heat exchange fin 140-2 may be configured only with the third surfaces 142*a*.

Accordingly, the heat exchange efficiency may be further improved through a structure in which the heat exchanger 1 and the rear heat exchanger 101 are arranged in two rows.

In addition, the air resistance of external air AF passing through portions adjacent to the second mouth 12 and the fourth mouth 112 through which the refrigerant flows out may be reduced through a structure in which the plurality of second tubes 30-3 and the plurality of fourth tubes 130-3 are disposed in a zigzag manner.

In addition, by disposing the second surfaces 42*b* and the fourth surfaces 142*c* on which the louver 44 is not formed at positions adjacent to the second mouth 12 and the fourth mouth 112 through which the refrigerant flows out, respectively, the frosting through contact with the external air AF may be prevented.

In the above, various embodiments of the disclosure have been individually described, but each embodiment does not have to be implemented alone, and the configuration and operation of each embodiment may be implemented in combination with at least one other embodiment.

In addition, although the embodiments of the disclosure have been illustrated and described hereinabove, the disclosure is not limited to the above-mentioned specific embodiments, but may be variously modified by those skilled in the art to which the disclosure pertains without departing from the scope and spirit of the disclosure as disclosed in the accompanying claims. These modifications should also be understood to fall within the scope of the disclosure.

The invention claimed is:

1. A heat exchanger comprising:

a first header including a first mouth and a second mouth;

a second header disposed parallel to the first header;

a tube assembly configured to connect the first header and the second header, the tube assembly including a plurality of first tubes configured to flow a refrigerant introduced from the first mouth in a first direction in which the second header is located and a plurality of second tubes that are continuously disposed with the plurality of first tubes and configured to flow the refrigerant introduced from the second header in a second direction opposite to the first direction; and a plurality of heat exchange fins including a plurality of insertion portions into which the plurality of first tubes and the plurality of second tubes are inserted and heat exchange surfaces provided between the plurality of insertion portions, wherein the plurality of heat exchange fins includes a first heat exchange fins adj acent to the first header among the plurality of heat exchange fins and a second heat exchange fins adjacent to the second header, wherein heat exchange surfaces of the first heat exchange fins include a first surface on which a louver is formed and a second surface flatly formed without the louver and heat exchange surfaces of the second heat exchange fins include only the first surface.

2. The heat exchanger as claimed in claim 1, wherein the tube assembly is disposed at an equal interval.

3. The heat exchanger as claimed in claim 1, wherein the plurality of first tubes are disposed at a first interval, the plurality of second tubes are disposed at a second interval, and the first interval is smaller than the second interval.

4. The heat exchanger as claimed in claim 3, wherein the first surface of the heat exchange surfaces of the first heat exchange fins has a first length equal to the first interval, and the second surface has a second length equal to the second interval.

5. The heat exchanger as claimed in claim 1, wherein each of the plurality of heat exchange fins further comprises a protrusion formed extending from one end of each of the heat exchange surfaces.

6. The heat exchanger as claimed in claim 5, wherein the protrusion protrudes more than the plurality of first tubes and the plurality of second tubes respectively inserted into the plurality of insertion portions.

7. The heat exchanger as claimed in claim 1, wherein the first header further comprises:

first insertion holes into which one end of the tube assembly is inserted; and a partition wall disposed between the first mouth and the second mouth, and wherein the second header further comprises second insertion holes into which another end of the tube assembly is inserted.

8. The heat exchanger as claimed in claim 1, wherein each of the plurality of first tubes and the plurality of second tubes is formed of aluminum (Al) material and includes a plurality of microchannels.

9. The heat exchanger as claimed in claim 1, further comprising:

a third header including a third mouth and fourth mouth and disposed in parallel with the first header at a rear of the first header;

a fourth header disposed in parallel with the second header at a rear of the second header;

a rear tube assembly configured to connect the third header and the fourth header, and disposed in parallel with the tube assembly at a rear of the tube assembly; and a plurality of heat exchange fins disposed along a length direction of the tube assembly and including third heat exchange fins disposed adjacent to the third header and fourth heat exchange fins disposed adjacent to the fourth header, wherein the rear tube assembly comprises:

a plurality of third tubes configured to flow a refrigerant introduced from the third mouth in a third direction in which the third header is located; and a plurality of fourth tubes configured to flow the refrigerant introduced from the third mouth in a fourth direction opposite to the third direction and disposed in zigzag with the plurality of second tubes.

10. The heat exchanger as claimed in claim 9, wherein heat exchange surfaces of each of the third heat exchange fins include a third surface on which a louver is formed and a fourth surface flatly formed adjacent to insertion portions into which the plurality of fourth tubes are inserted, and heat exchange surfaces of each of the fourth heat exchange fins include the third surface.

* * * * *